United States Patent [19]

Chateâu

[11] 4,088,107

[45] May 9, 1978

[54] ELECTRONIC IGNITION CONTROL DEVICE FOR A MOTOR VEHICLE

[75] Inventor: Louis Jean Château, Rosny sur Bois, France

[73] Assignee: Ducellier et Cie., Paris Cedex, France

[21] Appl. No.: 637,955

[22] Filed: Dec. 5, 1975

[30] Foreign Application Priority Data

Dec. 18, 1974 France ..... 74 41725

[51] Int. Cl.[2] ..... F02P 1/00; H05B 41/36

[52] U.S. Cl. ..... 123/148 E; 315/209 T; 123/146.5 A

[58] Field of Search ..... 123/148 E, 146.5 A, 123/148 R; 315/209 T

[56] References Cited

U.S. PATENT DOCUMENTS

| | | | |
|---|---|---|---|
| 3,219,878 | 11/1965 | Konopa | 123/148 E |
| 3,260,251 | 7/1966 | Lange | 315/209 T |
| 3,264,521 | 8/1966 | Huntzinger et al. | 123/148 E |
| 3,299,874 | 1/1967 | Elkind | 123/148 E |
| 3,878,824 | 4/1975 | Haubner et al. | 315/209 T |
| 4,016,849 | 4/1977 | Lei | 123/148 DC |

*Primary Examiner*—Charles J. Myhre
*Assistant Examiner*—Parshotam S. Lall

[57] ABSTRACT

An electronic ignition control device employs two switch devices (e.g. mechanical contact breakers) operating at different instants to control initiation and interruption of current flow in the primary winding of the ignition coil. The coil current is controlled by an output transistor which is biased to conduct but which is switched off by an input transistor when a spark is required. The input transistor is controlled by the two switch devices so that opening of one switch device initiates primary current and opening of the other interrupts this primary current.

4 Claims, 2 Drawing Figures

ELECTRONIC IGNITION CONTROL DEVICE FOR A MOTOR VEHICLE

Figure 1:
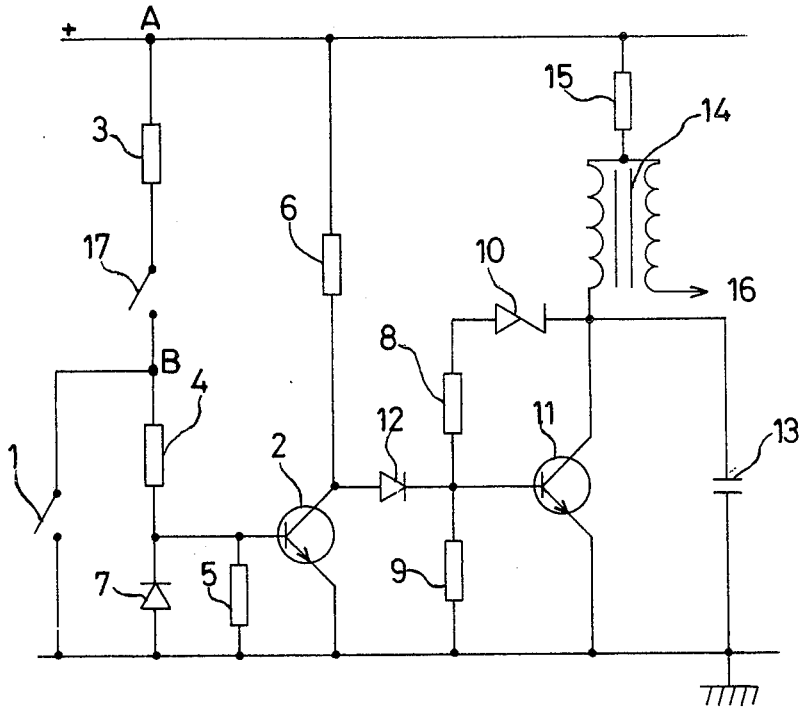

The present invention concerns an electronic ignition control device for a motor vehicle and has as a object to provide such a device in a convenient form.

In accordance with the invention there is provided an electronic ignition control device comprising the combination of first and second switch means for periodic operation by the engine and a current limiting resistor in series with said first and second switch means, a first transistor having its base connected to the series circuit consisting of said switch means and said resistor with the first switch means on one side of this base connection and the second switch meas and the resistor on the other side thereof, a second transistor connected to be controlled by the first transistor, and an ignition coil having a primary winding in the collector emitter circuit of the second transistor and a secondary winding providing a high voltage output for creating sparks in at least one spark plug, the arrangement being such that the first switch means controls the ignition timing and the second switch means controls the beginning of charging of the coil.

The description which follows with reference to the accompanying drawings will better facilitate an understanding of how the invention may be carried out. In the drawings:

FIG. 1 is a circuit diagram of one embodiment of the invention, and

FIGS. 2*a* to 2*d* are graphs showing operational curves of such a device.

The device shown comprises, in known manner, a contact breaker 1 in series with a resistance 3 of small value, which by its opening and closing controls the state of conduction of a transistor 2.

A resistance 4 connected between the base of the transistor 2 and a point B at the juncture of the contact breaker 1 and the resistance 3 assumes, in conjunction with the resistance 4, the function of input resistance of the base of the transistor 2. A diode 7 connected between the base and the emitter of the transistor 2 protects it from negative over-voltages which may be created during operation of the contact breaker.

The transistor 2 has its emitter earthed and its collector connected to a supply rail by a resistance 6. A second transistor 11 is controlled by the transistor 2 having its base coupled to the collector of the transistor 2.

A resistance 9 fixes the potential of the base of the transistor 11 which includes a protection circuit constituted by a resistance 8, a Zener diode 10 and a capacitor 13.

The junctions between the collector and emitter of the transistor 11 are in series with the primary winding of an ignition coil 14 and its load resistance 15. The secondary winding of the coil 14 delivers the necessary voltage for the creation of a spark at at least one spark plug 16.

A diode 12 conducting between the collector of the transistor 2 and the base of the transistor 11 causes the current passing through the Zener diode 10 to pass through the emitter-base junction of the transistor 11 when the over-voltage at the primary of the coil becomes too great and it is necessary to limit it by rendering the transistor 11 conducting when the Zener diode 10 becomes conducting.

A second contact breaker 17 is interposed between the resistance 3 and the point B. A resistance 5 is connected in parallel with the diode 7 in order that when the two contact breakers 1 and 17 are open at the same time, the base of the transistor 2 is connected to earth.

The operation of such a device is thus as follows. The contact breaker 17 opens and closes a predetermined angular interval $\alpha$ after the contact breaker 1.

First stage: the contact breaker 1 opens, the contact breaker 17 being still closed. The transistor 2 becomes conducting, and, the point B not being connected to earth, the potential of the collector of the transistor 2 is brought to earth potential to within the junction values and the transistor 11 is blocked which blocks the current through the primary of the coil 14. There is therefore the creation of a spark at the plug 16.

Second stage: the contact breaker 1 being still open, the contact breaker 17 opens. The transistor 2 is thus blocked and the transistor 11 conducts, thus permitting the charging of the primary of the coil 14.

Third stage: the contact breaker 1 closes, the contact breaker 17 being still open. The transistor 2 remains blocked and the transistor 11 remains conducting, so that the coil continues to charge.

Fourth stage: the contact breaker 1 remains closed, and the contact breaker 17 closes. The point B is at earth potential, so that the transistor 2 is still blocked and the transistor 11 is still conducting. The coil thus charges until the next opening of the contact breaker 1.

Figure 2:
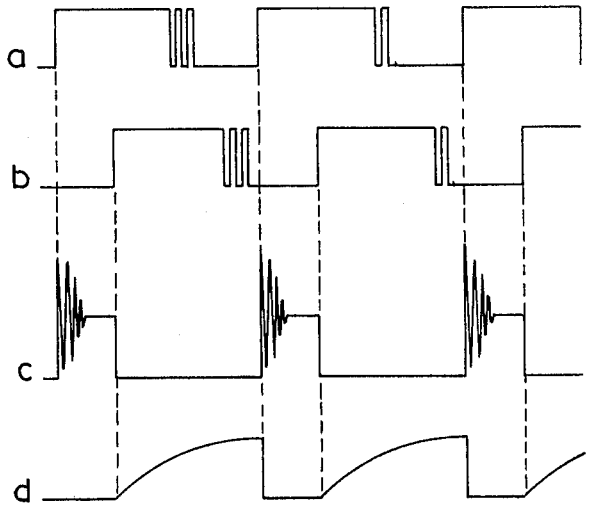

According to FIG. 2, it is notable that when the contact breaker 17 opens (curve 2*b*) and the coil begins to charge, the contact breaker 1 (curve 2*a*) is still open and the surges which took place when it closed have no influence on the ignition.

The curve 2*c* represents the ignition voltage in the primary of the coil characterised by its over-voltage at the moment of ignition.

The curve 2*d* represents the curve of charging current of the primary of the coil 14 at high speeds.

In the device described above, mechanical contact breakers have been used, but it is apparent that the use of two switch means such as magnetic reed switches produces the same result. To this end the contacts on other switches may be mounted on the same carrier in the conventional distributor assembly so that the angle $\alpha$ referred to above remains constant at all speeds irrespective of movement of the contact carrier by the speed advance mechanism of the distributor. Alternatively the switch contact 17 may be on a separate carrier movable by the speed advance mechanism to decrease the angle $\alpha$ as the speed increases and thereby maintain a more nearly constant coil charging time.

The operation is also the same if the contact breaker 17 is disposed between the resistance 3 and a point A corresponding to the supply of the device.

In the case of reed switches, the resistance 3 is of high value, the resistance 4 can then be omitted.

It is well understood that modifications can be made to these embodiments without departing from the scope of the invention.

I claim:

1. An electronic ignition control device for an engine provided with at least one spark plug and with an electrical supply, comprising the combination of first and second switch means for periodic operation by the engine, a current limiting resistor connected in series with said first and second switch means across said supply, a first transistor having its base connected by said first switch means to one pole of said supply and by said second switch means and said current limiting resistor to the other pole of said supply whereby said first transistor is turned on only when said first switch means is open and said second switch means is closed, a second transistor having its base connected to said first transistor so that its conductivity is controlled thereby, and an ignition coil having a primary winding in in the collector-emitter circuit of the second transistor and a secondary winding connected to said at least one spark plug, said second transistor being biased to conduct except when the first transistor is conductive, whereby opening of said second switch means causes said second transistor to turn on the initiate current flow in the primary winding and subsequent opening of said first switch means, after the second switch means has closed, causes the second transistor to turn off and thereby create a spark at said at least one spark plug.

2. A device as claimed in claim 1 in which the first switch means is connected at one side of the system earth and the second switch means is connected in series with said resistor between the other side of said first switch means and said supply.

3. A device as claimed in claim 1 in which the first and second switch means are mechanical contact breakers.

4. A device as claimed in claim 1 in which the first and second switch means are magnetically operable.

* * * * *